United States Patent [19]

Marco

[11] 4,007,847

[45] Feb. 15, 1977

[54] INTERLOCK ARRANGEMENT FOR USE WITH SIDELOADER FORK LIFT TRUCK

[75] Inventor: George P. Marco, Homewood, Ill.

[73] Assignee: Allis-Chalmers Corporation, Milwaukee, Wis.

[22] Filed: Oct. 30, 1975

[21] Appl. No.: 627,141

[52] U.S. Cl. ..... 214/670; 180/103 R; 212/145; 280/766

[51] Int. Cl.[2] ..... B66F 9/10

[58] Field of Search ..... 214/660, 670–674, 214/75 G; 212/145; 280/758, 763–766; 180/100, 82 R, 82 A, 103, 104; 187/9 R; 74/843, 844, 861

[56] References Cited

UNITED STATES PATENTS

| | | | |
|---|---|---|---|
| 2,400,803 | 5/1946 | Barnhart | 212/145 |
| 2,621,812 | 12/1952 | Lull | 214/670 X |
| 3,250,142 | 5/1966 | Schuster et al. | 180/103 R X |
| 3,595,409 | 7/1971 | Bowman-Shaw | 214/670 X |

FOREIGN PATENTS OR APPLICATIONS

| | | | |
|---|---|---|---|
| 525,763 | 9/1940 | United Kingdom | 180/82 A |

*Primary Examiner*—Robert J. Spar
*Assistant Examiner*—Lawrence J. Oresky
*Attorney, Agent, or Firm*—Robert C. Sullivan

[57] ABSTRACT

An interlock arrangement for use with a sideloader fork lift truck includes a solenoid valve which when electrically energized is "open" to dump to sump hydraulic fluid from the output line of the hydraulic pump, whereby to prevent passage to the clutches of the power shift transmission of the pressurized hydraulic fluid from the pump, thereby rendering the power shift transmission ineffective to transmit motive power from the engine to the drive wheels of the sideloader vehicle. A limit switch is stationarily mounted contiguous the piston portion of each stabilizing jack, each limit switch being a normally closed switch which is adapted to be open only when the piston portion is in a predetermined properly retracted position. The limit switches associated with the plurality of stabilizing jacks are connected in parallel electrical relation with each other in the electrical circuit of the aforementioned solenoid valve, whereby the solenoid valve is energized to cause dumping of the hydraulic pump output to sump when the piston portion of any one of the stabilizing jacks is not in the predetermined properly retracted position. When the solenoid valve is electrically unenergized, due to the fact that the piston portions of all stabilizing jacks are properly retracted, the solenoid valve moves to a position in which the output pressure line of the pump is no longer connected to sump, and pressurized hydraulic fluid from the pump is available for pressurizing the clutches of the power shift transmission, whereby to permit transmission of motive power from the engine to the drive wheels of the sideloader vehicle.

7 Claims, 4 Drawing Figures

INTERLOCK ARRANGEMENT FOR USE WITH SIDELOADER FORK LIFT TRUCK

BACKGROUND OF THE INVENTION

1. Field of the Invention

This invention relates to sideloader fork lift trucks having stabilizing jacks on at least one lateral side thereof, and more particularly to an interlock arrangement for preventing the transmission of motive power from the engine to the drive wheels of the sideloader vehicle when the stabilizing jacks are not in a predetermined properly retracted position.

2. DESCRIPTION OF THE PRIOR ART

It has been well known in the prior art to provide stabilizing jacks which are movable into ground-engaging relation on the loading side of a sideloader lift truck in order to stabilize the lift truck and prevent tipping thereof when the sideloader lift truck is in loading or unloading position, at which time the vehicle, of course, should not be in motion. When the loading or unloading operation has been completed and it is desired to place the drive wheels of the sideloader truck in motion, it is, of course, important that the stabilizing jacks be moved upwardly to a retracted position. It has been known in the prior art to provide a warning light or sound signal which is activated when the stabilizing jacks are in ground-engaging position or are otherwise not in properly retracted position, so that the operator will be aware that the stabilizing jacks are in such position and elevate them to their properly retracted position before proceeding to place the vehicle in motion.

OBJECTS OF THE INVENTION

Accordingly, it is an object of the present invention to provide for use with a sideloader lift truck having ground-engaging stabilizing jacks an interlock system which prevents motive power transmission from the engine to the drive wheels of the vehicle when all of the stabilizing jacks are not in a predetermined properly retracted position.

It is another object of the present invention to provide for use with a sideloader truck having ground-engaging stabilizing jacks an interlock system which renders the hydraulic power shift transmission of the vehicle ineffective to transmit motive power from the engine to the drive wheels of the vehicle when all of the stabilizing jacks are not in a predetermined properly retracted position.

SUMMARY OF THE INVENTION

In achievement of these objectives, there is provided in accordance with an embodiment of the invention an interlock arrangement for use with a sideloader fork lift truck to prevent transmission of motive power to the drive wheels of the vehicle when the pistons of the stabilizing jacks of the vehicle are not in a predetermined properly retracted position. Motive power is transmitted from the engine to the drive wheels of the vehicle through a hydraulic power shift transmission which includes clutches which must be pressurized from the output pressure line of a hydraulic pump in order for motive power to be transmitted to the drive wheels of the vehicle. The interlock system includes a solenoid valve which when electrically energized is open to dump to sump hydraulic fluid from the output line of the hydraulic pump, whereby to prevent passage to the clutches of the power shift transmission of the pressurized hydraulic fluid from the pump, thereby rendering the power shift transmission ineffective to transmit motive power from the engine to the drive wheels of the sideloader vehicle. A limit switch is stationarily mounted contiguous the piston portion of each stabilizing jack, each limit switch being a normally closed switch which is adapted to be open only when the piston portion is in a predetermined properly retracted position. The limit switches associated with the plurality of stabilizing jacks are connected in parallel electrical relation with each other in the electrical circuit of the aforementioned solenoid valve, whereby the solenoid valve is energized to cause dumping of the hydraulic pump output to sump when the piston portion of any of the stabilizing jacks is not respectively in the predetermined properly retracted position. When the solenoid valve is electrically unenergized, due to the fact that the piston portions of all stabilizing jacks are properly retracted, the solenoid valve moves to a position in which the output pressure line of the pump is no longer connected to sump, and pressurized hydraulic fluid from the pump is available for pressurizing the clutches of the power shift transmission, whereby to permit transmission of motive power from the engine to the drive wheels of the sideloader vehicle.

BRIEF DESCRIPTION OF THE DRAWINGS

Further objects and advantages of the invention will become apparent from the following description taken in conjunction with the accompanying drawings in which.

DESCRIPTION OF THE PREFERRED EMBODIMENT

Figure 2:
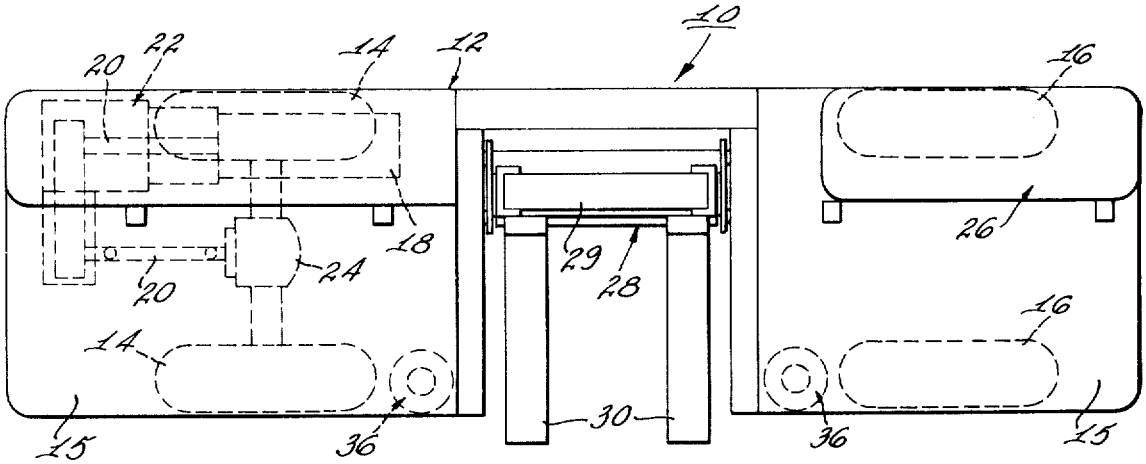
FIG. 2 is a top plan view of the sideloader vehicle of FIG. 1.
Figure 1:
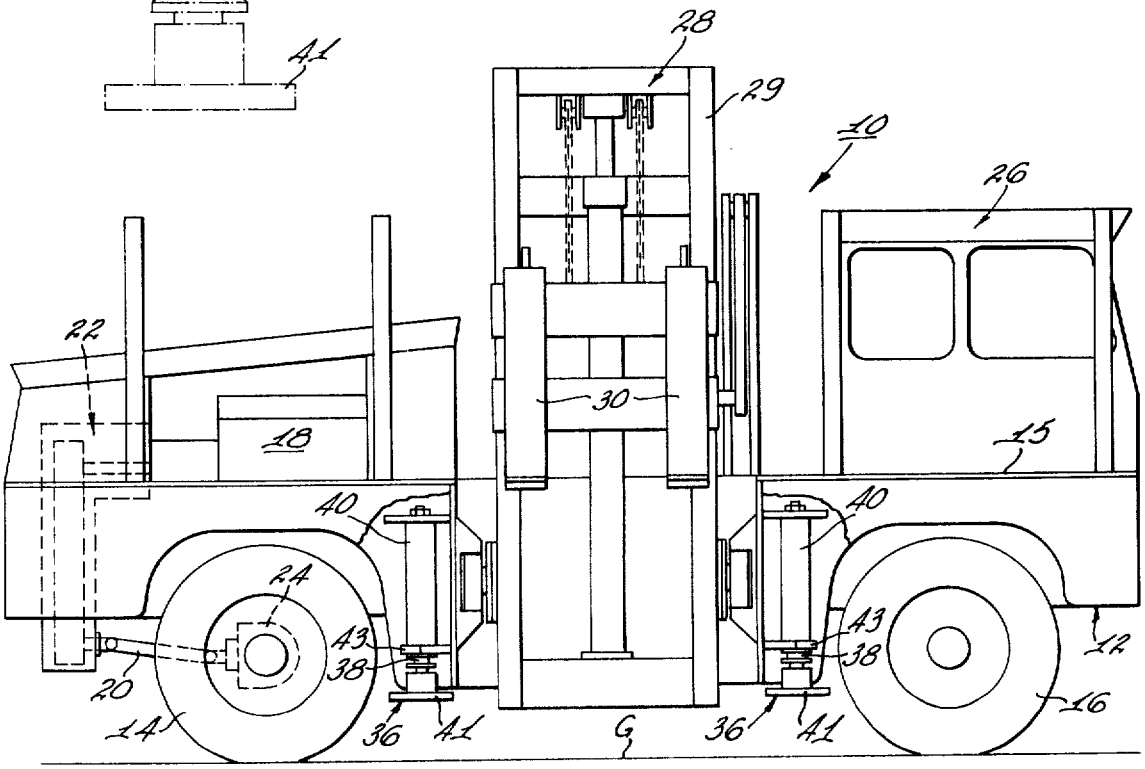
FIG. 1 is a view in side elevation of a sideloader truck embodying the interlock arrangement of the invention.

Referring now to the drawings and more particularly to FIGS. 1 sideloader 2, there is shown a sideloader fork lift truck generally indicated at 10 which is used for pick-up, loading, transporting and stacking of loads, particularly long, bulky loads. The sideloader vehicle 10 includes a chassis generally indicated at 12 which is supported for motion by rear drive wheels 14 and by steerable front wheels 16. Rear drive wheels 14 are driven by an internal combustion engine generally indicated at 18 mounted at one side of the deck 15 on chassis 12. Engine 18 is connected by a drive shaft 20 through a power shift transmission generally indicated at 22 (FIG. 4) to the input of differential gearing 24 and thence to rear drive wheels 14 of the sideload vehicle. An operator's compartment generally indicated at 26 (FIGS. 1 and 2) is provided at deck level at the forward end portion of the vehicle. Mounted at a generally central location lengthwise of vehicle 12 is a laterally shiftable mast structure 28 having a carriage 29 supporting a pair of longitudinally spaced lifting fork tines 30 for picking up, loading or stacking material as previously mentioned. The sideloader lift truck is most advantageous for handling long, bulky loads which extend in a direction parallel to the direction of travel. The lateral movement of the mast structure 28 and vertical movement of the carriage 29 permits movement of the material being handled from a pick-up location, and the depositing of the material thus picked up on the deck 15 of the vehicle whereby to support the material being handled during transportation.

In order to suitably stabilize the vehicle during the loading and unloading operations thereof, double acting stabilizing jacks generally indicated at 36 are suitably supported from longitudinally spaced positions on chassis 12 on opposite sides of the sideloading mast structure 28, and contiguous the lateral side of the vehicle at which the loading and unloading operations occur, whereby the stabilizing jacks when in ground-engaging position prevent tipping of the vehicle at the side of the vehicle where loading and unloading occur.

Jacks 36 include piston portions 38 which are movable in stationary hydraulic cylinders 40 under the influence of hydraulic pressure. Details of the hydraulic circuit arrangement for actuating the hydraulic jacks are not shown but would be obvious to a person skilled in the art. In the position shown in FIG. 1, and in full line in FIG. 3, the movable piston portion 38 of the respective hydraulic jacks 36 are shown in the fully retracted position, whereas in the position shown in phantom line in FIG. 3 and in full line in FIG. 4 the jack 36 is shown in its fully extended condition in which the foot 41 on the bottom of the piston portion 38 is in engagement with the floor surface G.

Figure 3:
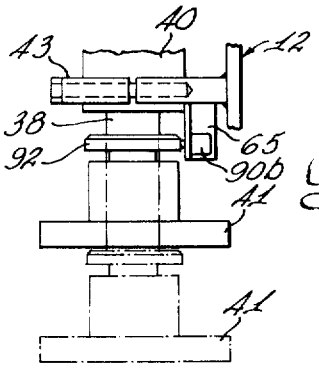
FIG.3 is a detail view showing the fully retracted condition of one of the stabilizing jacks in full line and with an abutment on the piston portion of the jack being shown in engagement with an interlock switch in the circuit of the control solenoid of the interlock system; and, with the fully advanced position of the same stabilizing jack being shown in phantom line.

In accordance with the invention, interlock means are provided for insuring that motive power from internal combustion engine 18 cannot be transmitted to rear drive wheels 14 of the sideloader vehicle if the piston portions 38 of both stabilizing jacks 36 are not in a predetermined properly retracted position in their respective cylinders 40 as shown in FIG. 1 and in full line in FIG. 3. The system by which this is accomplished will now be described.

Figure 4:
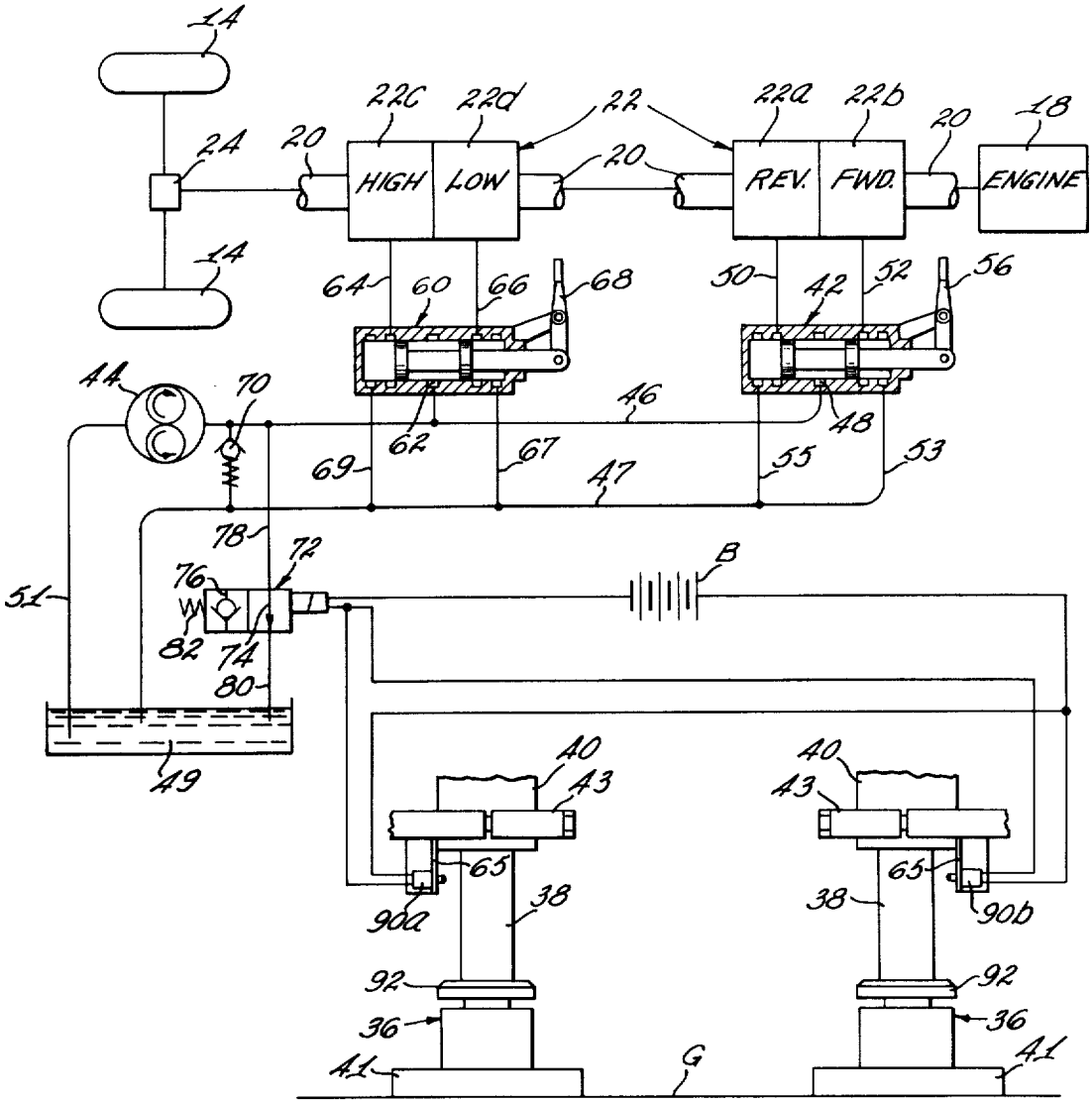
FIG. 4 is a diagrammatic view showing the arrangement of the power shift transmission used for the transmission of engine power to the drive wheels of the vehicle of FIGS. 1 and 2, together with a diagrammatic representation of the interlock system of the invention and its relation to the power shift transmission of the vehicle whereby the power shift transmission is rendered inoperative to transfer power to the drive wheels of the vehicle when all of the stabilizing jacks are not in a predetermined properly retracted condition.

Referring to FIG. 4, it will be noted that the power shift transmission generally indicated at 22 includes a reverse section indicated at **22*a*, a forward section indicated at 22*b*, a "high" speed section 22*c*, and a "low" speed section 22*d*. Each of the transmission sections 22*a*, 22*b*, 22*c*, and 22*d* includes a clutch which may be pressurized, and thus actuated to a power transmitting or engaged condition, by hydraulic fluid. In order to transmit motive power from engine 18 to rear wheels 14 of the vehicle, the clutch in either transmission section 22*a* or 22*b* must be engaged and also the clutch in either transmission section 22*c* or 22*d*** must be engaged.

A first selector valve indicated at 42 and operated by a manual operating lever 56 is provided to selectively connect the clutches of the reverse and forward transmission sections **22*a*, 22*b* to output conduit 46 of oil pump 44. The input of oil pump 44 is connected to sump 49 by conduit 51. Selector valve 42 is connected at input port 48 of valve 42 to pump output conduit 46. The output of selector valve 42 is selectively communicated through hydraulic lines 50, 52 to the respective reverse and forward sections 22*a*, 22*b* of power shift transmission 22. In the position shown in FIG. 4, the selector valve 42 is shown in its neutral position in which hydraulic pressure fluid from line 46 is not communicated through the selector valve 42 to either the reverse or the forward section 22*a* or 22*b*, respectively, of the power shift transmission 22. However, manual operating lever 56 of selector valve 42 may be actuated to selectively connect either conduit 50 leading to "reverse" section 22*a* or conduit 52 leading to the "forward" section 22*b* of the power shift transmission to the pump output line 46, in which case the corresponding reverse or forward clutch is pressurized and thus actuated for transmitting power from engine 18 to the rear wheels 14**.

Similarly, a selector valve generally indicated at 60 is provided to selectively actuate the high speed or low speed section **22*c* or 22*d* of power shift transmission 22. Selector valve 60 is connected to output line 46 of pump 44 at input port 62 of selector valve 60, and hydraulic lines 64 and 66, respectively, connect the output of selector valve 60 to high speed section 22*c* and to low speed section 22*d* of power shift transmission 22. In the position shown in FIG. 4, selector valve 60 is shown in its neutral position in which neither the high speed nor the low speed sections 22*c* or 22*d* of the transmission 22 is connected to the output line 46 of pump 44. However, selector valve 60 is provided with a manual operating member 68 which may be actuated to selectively connect either high speed section 22*c* or low speed section 22*d* of transmission 22 to output line 46 of pump 44 to thereby selectively pressurize either the clutch of high speed section 22*c* or the clutch of low speed section 22*d* whereby to cause the corresponding transmission section to be effective to transmit power from engine 18 to rear drive wheels 14** of the sideloader vehicle.

The hydraulic conduits 53 and 55 connect selector valve 42 to low pressure conduit 47 leading to sump 49. Similarly, the hydraulic conduits 67 and 69 connect selector valve 60 to low pressure conduit 47 leading to sump 49. The conduits 53, 55, 67, 69 may cooperate with ports in their corresponding selector valves to connect to sump 49 respective sections of power shift transmission 22 which are not pressurized at a given time.

As a protective device in the hydraulic circuit, a relief valve 70 is connected between output line 46 of pump 44 and low pressure line 47 leading to sump 49 to provide a bypass of hydraulic fluid from pump 44 to sump 49 when the pressure in pump output line 46 reaches a predetermined operating level or value.

INTERLOCK SYSTEM FOR STABILIZING JACKS

In accordance with the invention, an interlock system is provided to prevent transmission of motive power from engine 18 to rear drive wheels 14 of the sideloader vehicle in the event that both stabilizing jacks 36 are not in their fully retracted condition. The system by means of which this interlock arrangement is accomplished will now be described. A solenoid valve generally indicated at 72 is provided and includes an open passage 74 which permits passage of hydraulic fluid from pump 44 to sump 49 through valve 72, and a closed passage 76 with a check valve which prevents passage of hydraulic fluid through valve 72 from pump 44 to sump 49. Valve 72 is connected to pump output line 46 through hydraulic conduit 78 and to sump 49 through hydraulic conduit 80. When solenoid valve 72 is electrically energized, solenoid valve 72 moves against the force of spring 82 to a position in which open (i.e., permitting hydraulic flow to sump) passage 74 of the valve connects hydraulic conduit 78 leading from pump output line 46 to hydraulic conduit 80 leading to sump 49, as shown in the view of FIG. 4. Thus, when solenoid valve 72 is energized, as shown in FIG. 4, valve 72 is so positioned as to "dump" hydraulic fluid from pump output line 46 directly to sump 49 through hydraulic conduit 78, through open passage 74 of valve 72, and thence through hydraulic conduit 80 to sump 49.

On the other hand, if solenoid valve 72 is electrically deenergized, the valve 72 moves to the right with respect to the schematic view of FIG. 4 due to the force of spring 82 to cause closed (i.e., preventing hydraulic flow to sump) passage 76 to be in alignment with conduits 78 and 80, and in this position there is no fluid flow from pump output line 46 to sump 49.

A normally closed switch 90*a* or 90*b* is suitably supported by a corresponding bracket 65 (FIGS. 3 and 4) which in turn is secured to a clamp member 43 which secures the corresponding jack cylinder 40 to the stationary structure of the vehicle chassis. Switch 90*a* or 90*b* is supported contiguous the vertical path of movement of the piston portion 38 of the respective stabilizing jacks 36. Each of the switches 90*a*, 90*b* is a normally closed switch which is opened when the respective switches 90*a*, 90*b* are engaged by an abutment 92 on the piston portion 38 of the corresponding stabilizing jack 36. The two switches 90*a* and 90*b*, respectively, associated with each of the respective jacks 36 are electrically connected in parallel with each other and in series with the electrical winding of solenoid valve 72 and a source of electrical power represented by the battery B, whereby closure of either switch 90*a* or 90*b* will connect the electrical winding of solenoid valve 72 in series circuit with battery B, whereby to energize the electrical winding of solenoid valve 72.

When the two longitudinally spaced jacks 36 are in the ground-engaging vehicle stabilizing position shown in FIG. 4, the abutments 92 on the respective jacks do not engage the respective normally closed switches 90*a* and 90*b* and hence each of the switches is closed and the electrical circuit of solenoid valve 72 is energized. In this position of jacks 36 shown in FIG. 4 or in any extended position of the jacks 36 in which the respective abutments 92 do not engage the corresponding switches 90*a* and 90*b*, the circuit of solenoid valve 72 is energized and the valve is in the dump position shown in FIG. 4 in which the pressure output line 46 of pump 44 is connected directly to sump 49 through solenoid valve 72 as previously explained. When valve 72 is in the dump position shown in FIG. 4, pressurized hydraulic fluid is not supplied to the clutches of any of the sections 22*a*, 22*b*, 22*c* or 22*d* of power shift transmission 22, and hence motive power cannot be transmitted from engine 18 to rear drive wheels 14 of the sideloader vehicle.

On the other hand, when both jacks are properly retracted to the position shown in full line in FIG. 3 and are thus out of ground-engaging position, the abutments 92 on the respective stabilizing jacks will be so positioned, as seen in FIG. 3, as to maintain the respective normally closed switches 90*a* and 90*b* in open position, in which case the electrical circuit including the parallel-connected switches 90*a* and 90*b* will be open to deenergize solenoid valve 72 and to permit spring 82 to move valve 72 to the right relative to the view shown in FIG. 4 to a position in which the closed path 76 of the valve is in alignment with the hydraulic conduits 78 and 80, thereby preventing passage of hydraulic fluid from output pressure line 46 of pump 44 to sump 49. Thus, in the properly retracted position of both stabilizing jacks 36, in which switches 90*a* and 90*b* are both open to deenergize solenoid valve 72, pressurized hydraulic fluid is available in pump output line 46 for hydraulic connection through the respective selector valves 42 and 60 to the clutches of the various sections 22*a*, 22*b*, 22*c*, 22*d* of power shift transmission 22, thereby permitting transmission of motive power from engine 18 to rear drive wheels 14 of sideloader vehicle 10.

It will be noted that due to the parallel electrical connection of limit switches 90*a*, 90*b* with respect to each other, if either one or both of the stabilizing jacks 36 is/are not in predetermined proper retracted position the electrical circuit of solenoid valve 72 will be energized and the valve 72 will move to the dump position shown in FIG. 4. Thus, for motive power to be transmitted from engine 18 through power shift transmission 22 to rear drive wheels 14 of the sideloader vehicle, both stabilizing jacks 36 must be in their properly retracted position in which they open the respective switches 90*a* and 90*b* to deenergize the circuit of solenoid 72.

From the foregoing detailed description of the invention, it has been shown how the objects of the invention have been obtained in a preferred manner. However, modifications and equivalents of the disclosed concepts, such as readily occur to those skilled in the art, are intended to be included within the scope of this invention.

The embodiments of the invention in which an exclusive property or privilege is claimed are defined as follows:

1. In combination, a sideloader vehicle having means for handling material from at least one side of the vehicle which extends lengthwise of the vehicle, means for propelling said vehicle including an engine connected to drive wheels of the vehicle through a hydraulic power shift transmission, pump means hydraulically connected to said hydraulic power shift transmission for supplying a pressurized hydraulic fluid thereto, at least one stabilizing jack mounted on said vehicle, said stabilizing jack having a piston portion movable from a ground engaging stabilizing position to a retracted non-stabilizing position in which said piston portion does not engage the ground, and interlock means comprising means effective when said pistion portion of said jack is not in a predetermined retracted position to hydraulically connect the output of said pump means to a sump, whereby to render said hydraulic power shift transmission ineffective to transmit motive power from said engine to said drive wheels.

2. The combination defined in claim 1 in which said interlock means comprises an electrical solenoid valve, switch means in the energization circuit of said solenoid valve, said switch means being responsive to the presence of said piston portion of said jack in a position other than a predetermined proper retracted position to so control the state of energization of said solenoid valve as to hydraulically connect the output of said pump means to sump, whereby to render said transmission ineffective to transmit motive power from said engine to said drive wheels.

3. The combination defined in claim 2 in which said switch means is closed when said piston portion of said jack is in a position other than a proper predetermined retracted position, whereby to cause the energization of said solenoid valve, and means effective upon the energization of said solenoid valve to cause said solenoid valve to move to a position in which it hydraulically connects the output of said pump means to sump, whereby to render said transmission ineffective to transmit motive power from said engine to said drive wheels.

4. The combination defined in claim 2 comprising a plurality of stabilizing jacks, a corresponding switch means associated with and responsive to the position of the piston portion of each of said jacks, the plurality of switch means associated with the piston portions of said jacks being connected in parallel electrical relation with each other to control the state of energization of said solenoid valve, whereby when any one piston portion of said plurality of jacks is not in said predetermined retracted position said transmission is rendered ineffective to transmit motive power from said engine to said drive wheels.

5. An interlock arrangement for use with a sideloader vehicle of the type having means for handling material from at least one side of the vehicle which extends lengthwise of the vehicle, and in which said sideloader vehicle includes means for propelling said vehicle including an engine connected to drive wheels of the vehicle through a hydraulic power shift transmission, said hydraulic power shift transmission including hydraulically actuated clutches, said sideloader vehicle including pump means hydraulically connected to said clutches for supplying a pressurized hydraulic fluid thereto, at least one stabilizing jack mounted on said vehicle, said stabilizing jack having a piston portion movable from a ground-engaging stabilizing position to a retracted nonstabilizing position in which said piston portion does not engage the ground, and in which said interlock arrangement comprises a cooperative relation with said piston portion including means effective when said piston portion is not in a proper predetermined retracted position to hydraulically connect the output of said pump means to a sump, whereby to prevent actuation of said clutches and thereby rendering said hydraulic power shift transmission ineffective to transmit motive power from said engine to said drive wheels.

6. The interlock arrangement defined in claim 5 which comprises an electrical solenoid valve, switch means in the energization circuit of said solenoid valve, said switch means being responsive to the presence of said piston portion in a position other than a predetermined retracted position to so control the state of energization of said solenoid valve as to cause said solenoid valve to hydraulically connect the output of said pump means to sump, whereby to render said transmission ineffective to transmit motive power from said engine to said drive wheels.

7. The interlock arrangement defined in claim 6 in which said switch means is closed when said piston portion is in a position other than a proper predetermined retracted position, whereby to cause the energization of said solenoid valve, and means effective upon the energization of said solenoid valve to cause said solenoid valve to move to a position in which it hydraulically connects the output of said pump means to sump, whereby to render said transmission ineffective to transmit motive power from said engine to said drive wheels.

* * * * *